US006088552A

United States Patent [19]

Morinaga et al.

[11] Patent Number: 6,088,552

[45] Date of Patent: Jul. 11, 2000

[54] DEVELOPER ACCOMODATING CONTAINER AND DEVELOPING DEVICE

[75] Inventors: Hiroumi Morinaga, Susono; Toshiaki Nagashima, Mishima, both of Japan

[73] Assignee: Canon Kabushiki Kaisha, Tokyo, Japan

[21] Appl. No.: 09/324,648

[22] Filed: Jun. 3, 1999

[30] Foreign Application Priority Data

Jun. 5, 1998 [JP] Japan ..... 10-173900

[51] Int. Cl.[7] ..... G03G 15/08

[52] U.S. Cl. ..... 399/106; 399/103

[58] Field of Search ..... 399/98, 102, 103, 399/105, 106, 262

[56] References Cited

U.S. PATENT DOCUMENTS

| | | | |
|---|---|---|---|
| 4,092,954 | 6/1978 | Hudson | 399/103 |
| 4,895,104 | 1/1990 | Yoshino et al. | 399/106 |
| 5,778,282 | 7/1998 | Nagashima | 399/106 |
| 5,802,431 | 9/1998 | Nagashima et al. | 399/262 |
| 5,832,349 | 11/1998 | Nagashima | 399/262 |
| 5,926,675 | 7/1999 | Miyano et al. | 399/262 |
| 5,937,237 | 8/1999 | Nonaka et al. | 399/106 |
| 5,978,624 | 11/1999 | Garcia et al. | 399/106 |

*Primary Examiner*—Sandra L Brase

*Attorney, Agent, or Firm*—Fitzpatrick, Cella, Harper & Scinto

[57] ABSTRACT

A developer accommodating container and a developing device that require less force to pull out a sealing member thereby to permit easier opening of the developer accommodating container. The developer accommodating container includes a container main body for accommodating a developer, the container main body having an opening through which the developer is supplied to a development container; and a sealing member which seals the opening and can be pulled out, the sealing member having a sealant surface fixed to the container main body; wherein the sealing member is pressed by an end seal provided on an end on a side, from which the sealing member is pulled out, to prevent the developer adhering to the sealing member from leaking out when the sealing member is pulled out, and a surface of the sealing member which is provided with the sealant surface that has an area with a friction coefficient smaller than that of the sealant surface, the area being located in a portion that comes in contact with the end seal at the beginning of pulling out the sealing member.

18 Claims, 11 Drawing Sheets

FIG. 12
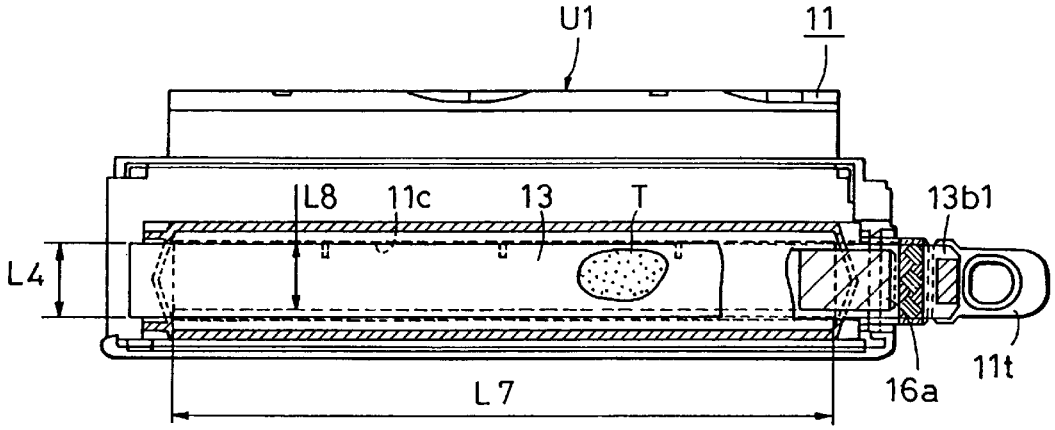
FIG. 13A
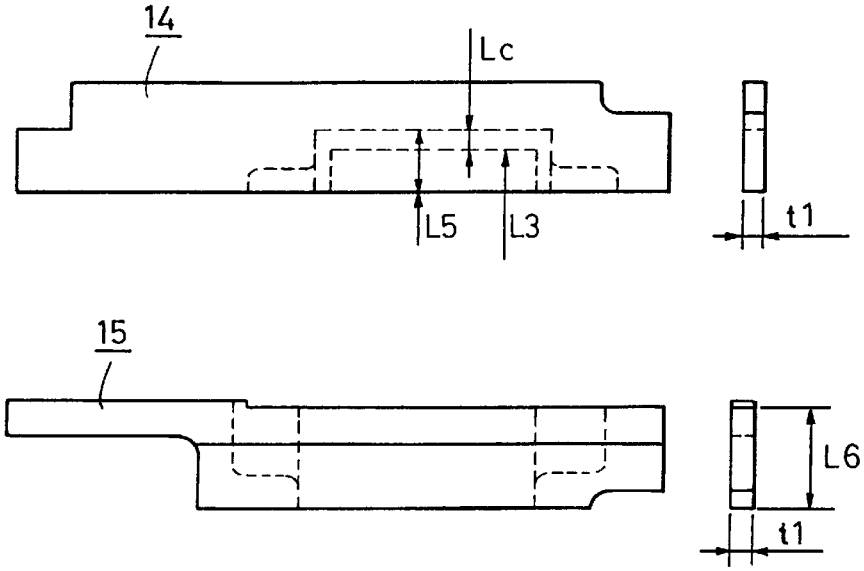
FIG. 13B

DEVELOPER ACCOMODATING CONTAINER AND DEVELOPING DEVICE

BACKGROUND OF THE INVENTION

1. Field of the Invention

The present invention relates to a developer accommodating container used for supplying a developer or toner to a developing device of an image forming apparatus such as an electrostatic copier or a printer, and a developing device which is equipped with a developer accommodating container supplying a developer to a developing unit provided with a developer bearing member that bears a developer and which is detachably mounted on the main body of an image forming apparatus.

2. Description of the Related Art

Hitherto, electrophotographic recording apparatuses or electrophotographic image forming apparatuses have been used in printers, copiers, etc. The developing devices of the electrophotographic recording apparatuses use a developer (hereinafter referred to as "toner").

The toner is consumed as an image forming process proceeds and therefore must be replenished as necessary. There is available a toner accommodating container or a developer accommodating container used for replenishing the toner once to the developing apparatus, such as a copier, and as a toner accommodating container of a process cartridge used with a printer for an information terminal such as a computer, a facsimile, or a CAD system.

In a typical process cartridge, the opening of a toner accommodating container or a toner outlet, is sealed with a toner seal or a sealing member. To discharge toner to a developing unit equipped with a development roller or a developer bearing member carrying the toner, the toner seal is pulled out externally to open the container. Thus, the toner can be discharged onto the developing unit through the opening of the toner accommodating container. A lengthwise end of the developing unit is provided with an elastic end seal that presses the toner seal against the accommodating container to prevent the toner from leaking when the toner seal is removed.

The sealant surface of the toner seal in the conventional toner accommodating container or process cartridge should be made of a material that easily clings to the main body of the container. However, under a storage environment of high temperature and high humidity, there are cases where the toner seal and the end seal adhere to each other in a pseudo manner, and the sliding strength, i.e., opening strength, of the toner seal especially at the beginning of pulling becomes high. Likewise, there are cases where a portion of the toner seal to which the toner has adhered exhibits high sliding strength, i.e., the opening strength, from the pulling start of the toner seal until it reaches the end seal.

SUMMARY OF THE INVENTION

Accordingly, an object of the present invention is to provide a developer accommodating container and a developing device that prevent pseudo adhesion between a sealing member and an end seal while maintaining the sealing performance of the sealing member.

Another object of the present invention is to provide a developer accommodating container and a developing device that require a less force to pull out a sealing member so as to permit easier opening of the developer accommodating container.

BRIEF DESCRIPTION OF THE DRAWINGS

FIG. 5 includes outside perspective views of the process cartridge with its developing unit and cleaning unit separated, wherein

FIG. 9 shows low-friction members disposed on a toner seal of the toner frame assembly, wherein

FIG. 10 shows the positional relationships between an end seal (1) and an end seal (2) when the development frame assembly and the toner frame assembly have been coupled, in which

FIG. 12 shows the major dimensions of a toner seal and a toner discharge opening;

FIGS. 13A and 13B, show the dimensional relationships between the end seals (1) and (2) and the toner seal, and the low-friction member in accordance with the second embodiment;

DESCRIPTION OF THE PREFERRED EMBODIMENTS

A developer accommodating container and a developing device in accordance with the present invention will now be described in conjunction with the accompanying drawings.

First Embodiment

A first embodiment exemplifies a process cartridge that is detachably mounted on the main body of an electrophotographic image forming apparatus for forming an image on an electrophotographic photosensitive member serving as an image bearing member by using an electrophotographic image forming process.

[Configuration of Electrophotographic Image Forming Apparatus]

Figure 1:
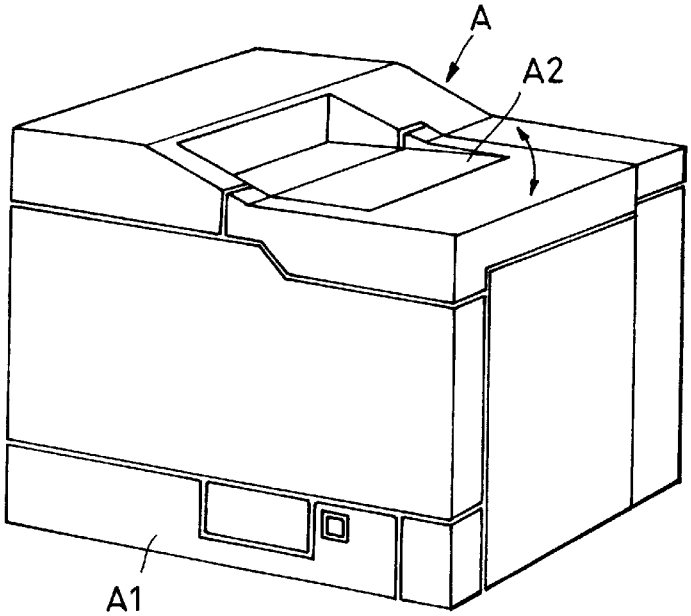
FIG. 1 is an outside perspective view of an electrophotographic image forming apparatus, namely, a laser beam printer, on which a process cartridge in accordance with a first embodiment is detachably mounted.
Figure 2:
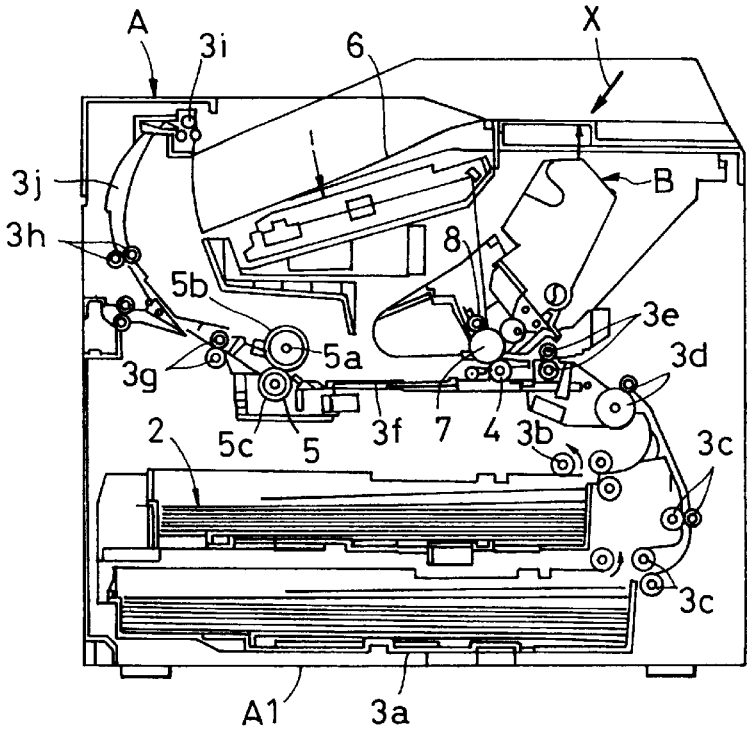
FIG. 2 is a schematic diagram showing the internal configuration of the electrophotographic image forming apparatus shown in FIG. 1.

FIG. 1 is an outside view of an electrophotographic image forming apparatus, and FIG. 2 is a schematic sectional view illustrative of the internal configuration of the electrophotographic image forming apparatus. In this embodiment, the electrophotographic image forming apparatus will be exemplified by a laser beam printer.

A process cartridge B in accordance with the first embodiment can be removably attached to an electrophotographic image forming apparatus main body (hereinafter referred to as "apparatus main body") A1 of an electrophotographic image forming apparatus (hereinafter referred to as "image forming apparatus") A, which is shown in FIG. 1 and FIG. 2, in a direction of an arrow X shown in FIG. 2 by opening and closing a cartridge cover or an opening/closing member A2 provided at the top of the apparatus main body A1.

The image forming apparatus A, or laser beam printer, forms an image on a recording medium such as recording paper, an OHP sheet, or cloth by an electrophotographic image forming process as shown in FIG. 2. A toner image is then formed on a drum-shaped electrophotographic photosensitive member 7 (hereinafter referred to as "photosensitive drum"). To be more specific, the photosensitive drum 7 is charged by a charging means 8, then a laser beam based on image information is irradiated from an optical means 1 to the photosensitive drum 7 to form an electrostatic latent image on the photosensitive drum 7. The latent image is developed by a developing means 9 to produce a toner image. In synchronization with the formation of the toner image, a recording medium 2 set on a paper feed cassette 3*a* is inversely carried through a pickup roller 3*b*, pairs of carrying rollers 3*c* and 3*d*, and a pair of resist rollers 3*e*. Subsequently, the toner image formed on the photosensitive drum 7 of the process cartridge B is transferred onto the recording medium 2 by applying a voltage to a transfer roller 4 serving as a transferring means. After that, the recording medium 2 onto which the toner image has been transferred is carried to a fixing means 5 via a carrying guide 3*f*. The fixing means 5 has a fixing roller 5*b* incorporating a drive roller 5*c* and a heater 5*a*. Heat and pressure are applied to the passing recording medium 2 thereby to fix the transferred toner image. Then, the recording medium 2 is carried through pairs of ejecting rollers 3*g* and 3*h* and an ejecting roller 3*i*, and passed through an inverting path 3*j* before it is ejected to an ejection tray 6. The ejection tray 6 is provided on the top surface of the apparatus main body A1 of the image forming apparatus A.

[Configuration of Process Cartridge]

The process cartridge will now be described with reference to FIG. 3 and FIG. 4.

Figure 3:
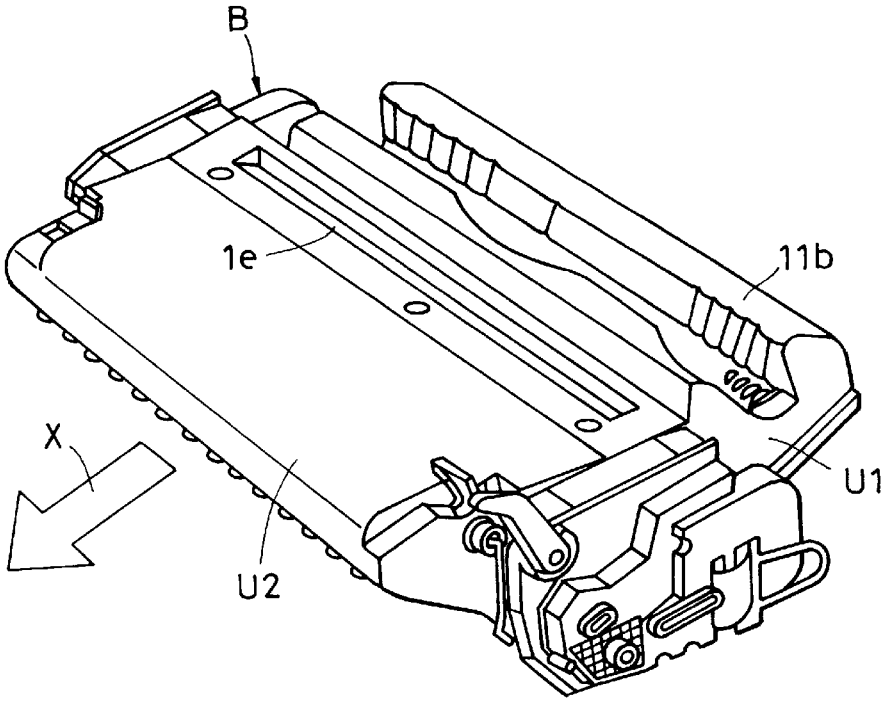
FIG. 3 is an outside perspective view of the process cartridge.
Figure 4:
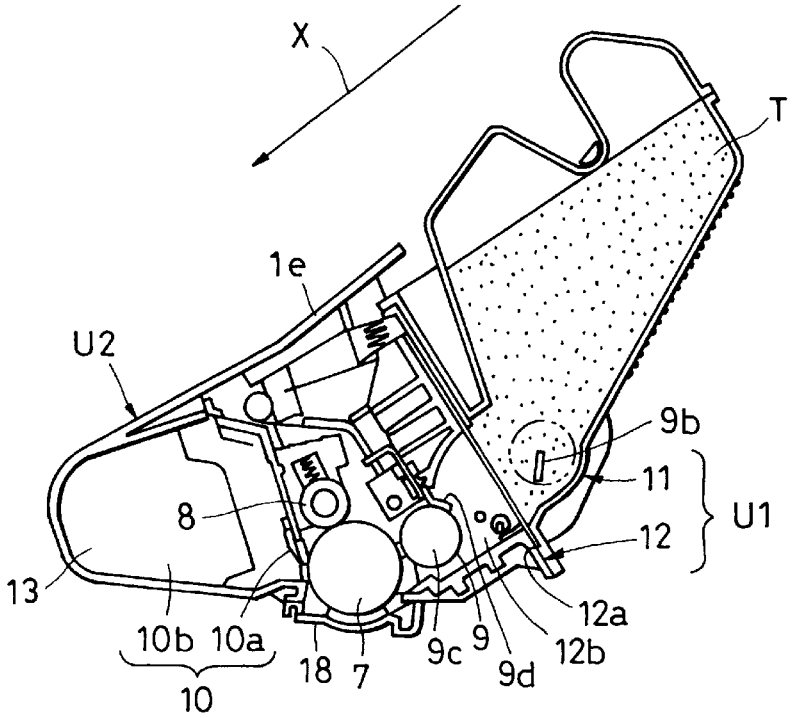
FIG. 4 is a schematic sectional side view of the process cartridge.

FIG. 3 is an outside perspective view of the process cartridge, and FIG. 4 is a schematic side sectional view of the process cartridge.

In the process cartridge B, a developing unit U1 and a cleaning unit U2 are rotatably coupled by a round pin coupling member, not shown, to constitute a housing. The housing is detachably mounted on the apparatus main body A1. The developing unit U1 has a toner frame member 11 serving as a developer accommodating container and a development frame assembly 12 serving as a development container supporting a developing means 9. The cleaning unit U2 has the photosensitive drum 7, a charging means 8, a cleaning means 10, and a cleaning frame member 13 supporting the charging means 8 and the cleaning means 10, and a drum shutter 18.

When the process cartridge B is removed from the apparatus main body A1, the drum shutter 18 covers the photosensitive drum 7 to protect it from being exposed to light for an extended time or from contact with foreign matters. The drum shutter 18 is rotatably installed to the developing unit U1 via a link component, which is not shown.

When the process cartridge B is installed in place on the image forming apparatus, the photosensitive drum 7 having a photosensitive layer is rotated and the surface thereof is uniformly charged by a voltage applied to the charging roller 8 serving as the charging means as shown in FIG. 4. Then, a laser beam based on image information is irradiated from the optical means 1 to the photosensitive drum 7 via an exposure aperture 1*e* so as to form a latent image. The latent image is then developed with toner by the developing means 9. Thus, the charging roller 8 is provided such that it is in contact with the photosensitive drum 7 and it rotates, following the photosensitive drum 7. The developing means 9 supplies the toner to the development area of the photosensitive drum 7 to develop the latent image formed on the photosensitive drum 7. The developing means 9 sends out toner T in the toner frame member 11, which will be discussed hereinafter, to a development roller 9*c*, which serves as a developer bearing member, as a toner feed member 9*b* rotates. Next, the development roller 9*c* that incorporates a fixed magnet is rotated, and a toner layer, to which frictionally charged electric charges have been imparted, is formed on the surface of the development roller 9*c* by means of a development blade 9*d*, and the toner is supplied to the development area of the photosensitive drum 7. The toner is then transferred to the photosensitive drum 7 based on the latent image to form a toner image, thereby producing a visible image. The development blade 9*d* functions to regulate the amount of toner on the peripheral surface of the development roller 9*c* and to impart frictionally charged electric charges. A toner stirring member for circulating the toner in a development member 12*b* is rotatably installed in the vicinity of the development roller 9*c*.

A voltage having the polarity opposite to that of the toner image is applied to the transfer roller 4 to transfer the toner image formed on the photosensitive drum 7 onto the recording medium 2, then the toner remaining on the photosensitive drum 7 is removed by the cleaning means 10. The cleaning means 10 scrapes off the toner remaining on the photosensitive drum 7 by means of an elastic cleaning blade 10*a* provided in contact with the photosensitive drum 7 and gathers it in a waste toner reservoir 10*b*.

[Configuration of Developing Unit]

The developing unit U1 will now be described in detail in conjunction with FIG. 4 through FIG. 7.

Figure 5B:
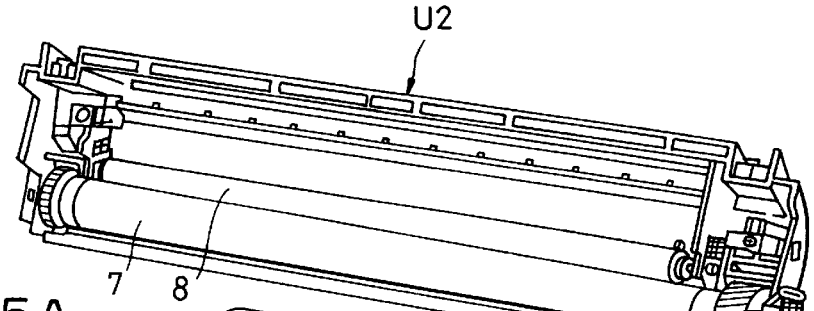
FIG. 5A is an outside perspective view of the developing unit and FIG. 5B is an outside perspective view of the cleaning unit.
Figure 5A:
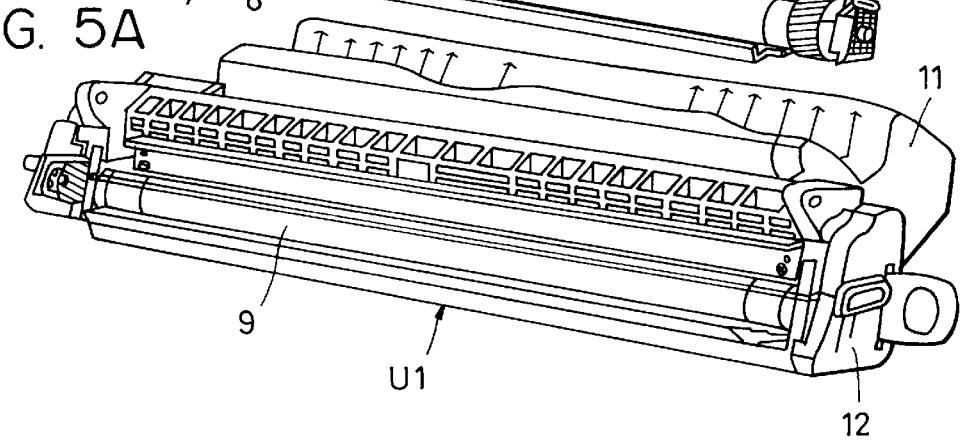
Figure 6:
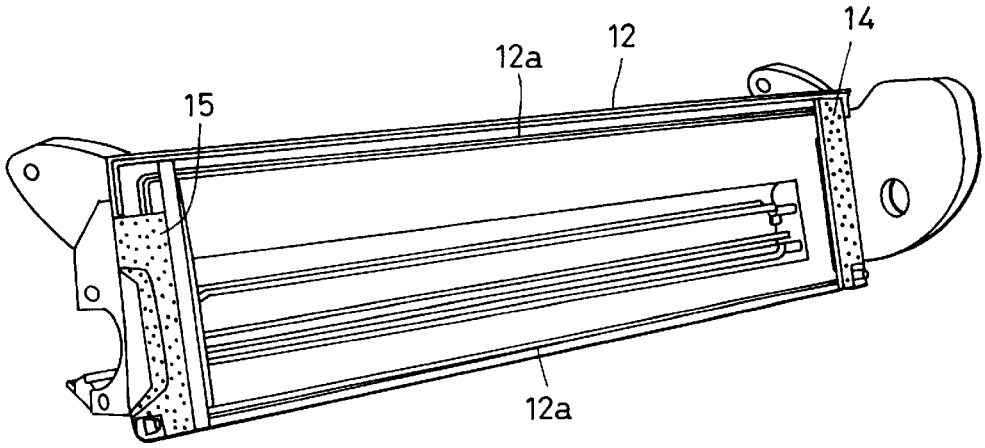
FIG. 6 is an outside perspective view of a development frame assembly constituting the developing unit.

FIG. 5 includes outside perspective views illustrative of the developing unit and the cleaning unit of the process cartridge separated, wherein FIG. 5A is an outside perspective view of the developing unit, and FIG. 5B is an outside perspective view of the cleaning unit. FIG. 6 is an outside perspective view of the development frame assembly constituting the developing unit, and FIG. 7 is an outside perspective view of the toner frame assembly constituting the developing unit.

Figure 7:
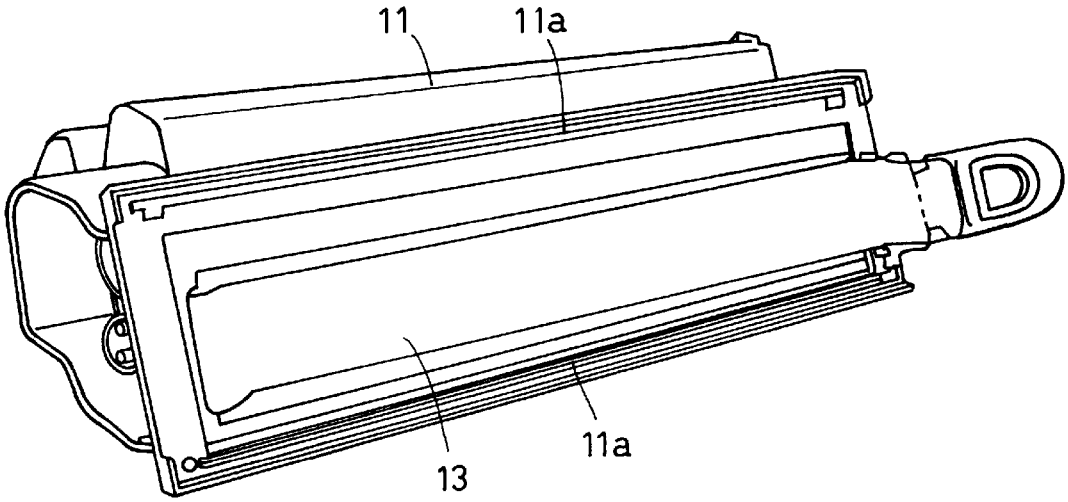
FIG. 7 is an outside perspective view of a toner frame assembly constituting the developing unit.

As shown in FIGS. 4, 6, and 7, the developing unit U1 is formed of the toner frame assembly 11 and the development frame assembly 12. In the lengthwise direction of the toner frame assembly 11 and the development frame assembly 12, ribs 12*a* provided on the development frame assembly 12 such that they are substantially parallel with each other are integrally welded to opposed flanges 11*a* of the toner frame assembly 11. On both lengthwise ends of the development frame assembly 12, an elastic end seal (*1*) 14 and an elastic end seal (2) 15 are fixed by double-sided tape as shown in FIG. 6.

[Configuration of Toner Frame Assembly (Developer Accommodating Container)]

Figure 8:
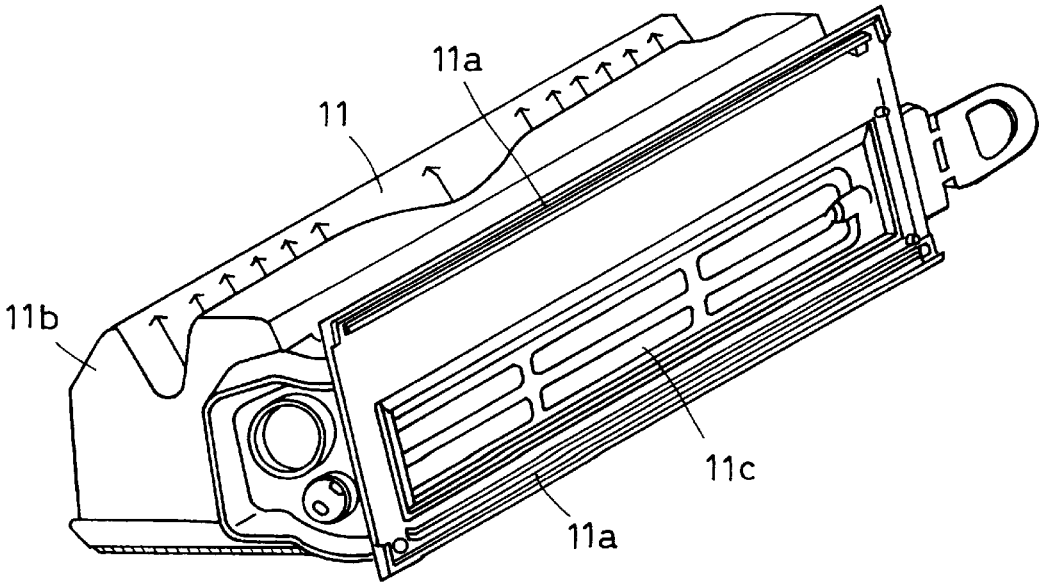
FIG. 8 is an outside perspective view of a toner container constituting the toner frame assembly.

The toner frame assembly 11 will now be described with reference to FIG. 8 and FIG. 9. FIG. 8 is an outside perspective view of a toner container constituting the toner frame assembly. FIG. 9 shows low-friction members disposed on a toner seal that hermetically seals the toner discharge opening of the toner container, wherein FIG. 9A shows a low-friction member disposed on a pull-out end portion of the toner seal, and FIG. 9B shows a low-friction member disposed lengthwise on the entire pull-out portion of the toner seal.

Figure 9A:
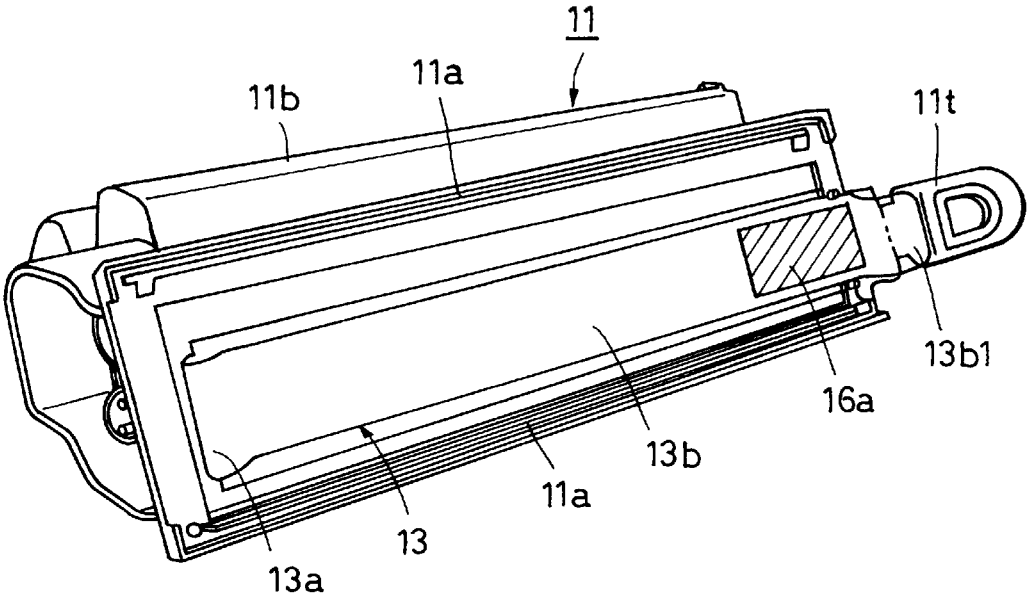
FIG. 9A shows a low-friction member in accordance with a first embodiment.
Figure 9B:
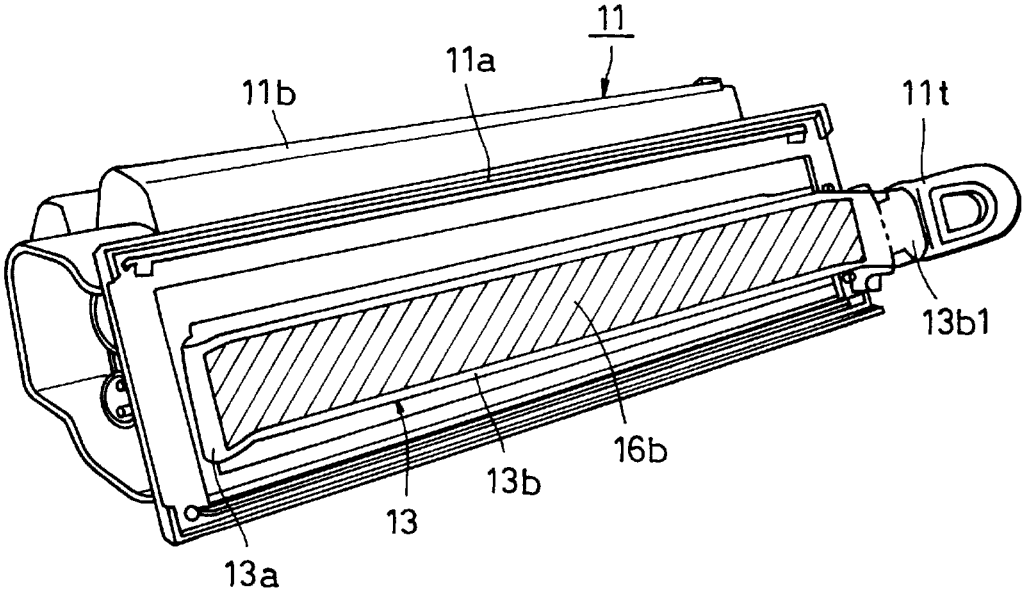
FIG. 9B shows a low-friction member in accordance with a second embodiment.

As shown in FIG. 9, the toner frame assembly 11 is constituted by a toner container accommodating toner, i.e., a container main body 11*b*, a filmy, flexible toner seal 13 serving as a sealing member, and a low-friction member 16*a* (refer to FIG. 9A) or a low-friction member 16*b* (refer to FIG. 9B). The toner container 11*b* is provided with a toner discharge opening 11*c*, shown in FIG. 8, to supply toner to the development member 12*b* of the development frame assembly 12. A toner seal 13 for hermetically sealing the toner discharge opening 11*c* is welded around the toner discharge opening 11*c* as shown in FIG. 9. The toner seal 13 is formed such that it is longer than the lengthwise dimension of the toner discharge opening 11*c*. A distal end 13*b*1 of a pull-out portion 13*b* shaped like a band in the lengthwise direction and folded back at a lengthwise end 13*a* of the toner discharge opening 11*c* is attached to a handle 11*t* provided on the toner container 11*b*. The handle 11*t* is formed integrally with the toner container 11*b* and it is formed such that the portion thereof linked to the toner container 11*b* is made particularly thin to allow itself to be severed from the toner container 11*b*.

As mentioned above, the toner seal 13 seals the toner discharge opening 11*c* to hermetically seal the toner in the toner container 11*b* to prevent the toner held in the toner container 11*b* from being discharged to the development member 12*b* until the use of the process cartridge B is started. In the toner seal 13, the low-friction member 16*a* that has a lower friction coefficient than a pull-out portion 13*b* is disposed at the distal end portion of the pull-out portion 13*b* as shown in FIG. 9A. Alternatively, the low-friction member 16*b* that has a lower friction coefficient than the pull-out portion 13*b* is disposed on the entire lengthwise area of the pull-out portion 13*b* as shown in FIG. 9B. The coefficient of the friction between the low-friction members and the end seal 15 is set lower than that between a sealant layer and the end seal 15. The disposition and material of the low-friction members 16*a* and 16*b* will be described in detail hereinafter.

The toner seal 13 employs, as its material, a film which is composed of an ethylene-vinyl-acetate copolymer type sealant layer laminated to a polyester base material and has a total thickness of 0.095 to 0.245 mm.

Figure 17:
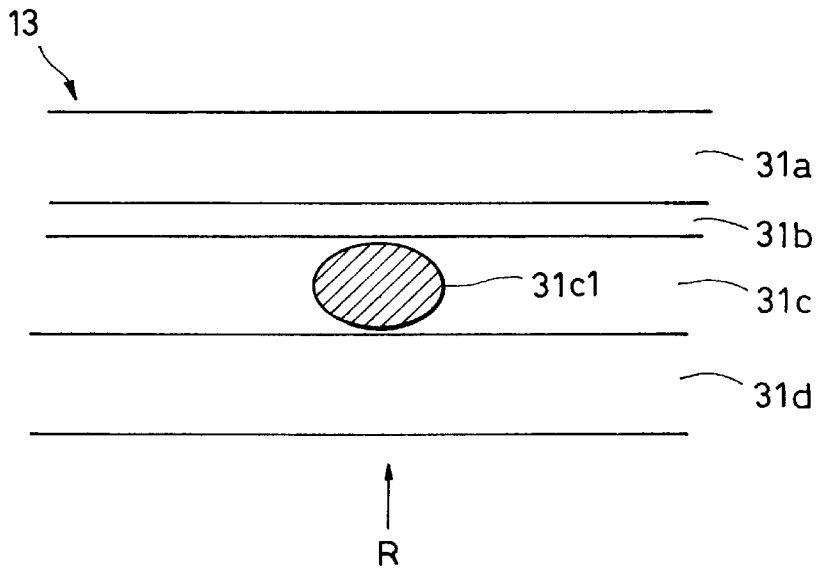
FIG. 17 is a diagram showing the layer configuration of the toner seal.
Figure 18:
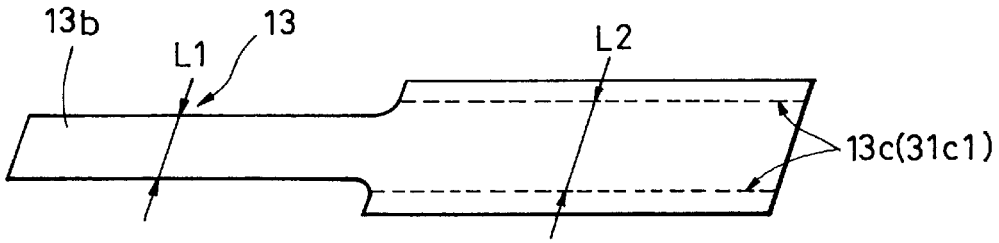
FIG. 18 is a general perspective view of the toner seal.

To be more specific, as shown in FIG. 17 and FIG. 18, the toner seal 13 is equipped with a tearing guide layer 31*c* having a tearing guide 13*c* (31*c*1) thermally fused continuously by a carbon dioxide laser, and it has a layer configuration consisting of a surface layer 31*a*, a laser shielding layer 31*b*, a tearing guide layer 31*c*, and a sealant layer 31*d*. The toner seal 13 is torn along the tearing guide 13*c* to become a torn portion.

The surface layer 31*a* employs a biaxial oriented polyester film (PET). To thermally seal the toner container 11*b* of the toner frame assembly 11, the thickness of the surface layer 31*a* is preferably 10 μm to 80 μm, and further preferably 12 μm to 17 μm to permit the broadest possible thermal heating conditions and to ensure good tearing performance without sacrificing the film strength.

In this embodiment, the surface layer 31*a* of the toner seal 13 employs the biaxial oriented PET which is 12 μm thick.

The laser shielding layer 31*b* is formed of an aluminum foil which does not optically absorb the beams of a carbon dioxide laser R and which securely suppresses the deterioration in the film strength of the surface layer 31*a* caused by progress in crystallization attributable to the radiant heat generated when the tearing guide layer 31*c* is thermally melted by the carbon dioxide laser R applying beams to the sealant layer 31*d*. Preferably, the thickness of the aluminum foil ranges from 5 μm to 15 μm, and more preferably, from 7 μm to 12 μm. In this embodiment, the thickness of the aluminum foil is set to approximately 7 μm.

The tearing guide layer 31*c* employs a biaxial oriented PET. Preferably, the thickness of the layer 31*c* ranges from 40 μm to 70 μm, and more preferably, from 40 μm to 60 μm in order to permit optimum optical absorption of the beams of the carbon dioxide laser R so that the portion 31*c*1, to which laser beams are radiated, thermally melts to provide the tearing guide 13*c* without fail by the optical absorption as the laser beams are continuously radiated. This is not to cause damage to the sealant layer 31*d* attributable to undue laser beam absorption, and also not to cause sacrifice in laser machining speed. In this embodiment, the thickness of the tearing guide 13*c* is set to approximately 50 μm.

The sealant layer 31*d* is formed of a layer containing an ethylene-vinyl-acetate (EVA) copolymer that exhibits satisfactory heat sealing performance and adhesive strength. The thickness of the sealant layer 31*d* is preferably 40 μm to 80 μm, and more preferably, 40 μm to 60 μm. In this embodiment, the thickness of the sealant layer 31*d* is set to approximately 50 μm.

The sealant content ratio of the vinyl acetate copolymer (EVA) in the sealant layer 31*d* is 10 wt % or less. The molecular weight distribution based on the gel permeation chromatography of the ethylene-vinyl-acetate copolymer does not show a relative maximum for a molecular weight below 100000, while it shows at least one relative maximum for a molecular weight of 100000 or more.

The tearing guide layer 31*c* of the toner seal 13 described above is thermally melted to laser-process one of the four layers without causing damage to the sealant layer 31*d* attributable to the irradiation of laser beams.

The respective layers from the surface layer 31*a* to the sealant layer 31*d* are fixed by bonding with dry lamination.

In this embodiment, the thickness of the film after the dry lamination is set to approximately 128 μm.

The configuration of the process cartridge B integrated as mentioned above and, more specifically, the configuration of the coupled portion of the developing unit U1 will be described in further detail.

In the developing unit U1, to couple the development frame assembly 12 and the toner frame assembly 11, two deposited ribs 12*a* are provided on either the development frame assembly 12 or the toner frame assembly 11 in the lengthwise direction of the frame assembly such that they are substantially parallel to each other, and the deposited ribs 12*a* are coupled and fixed to the mating frame assembly by ultrasonic bonding.

Incidentally, the toner frame assembly 11 and the development frame assembly 12 are formed of a plastic constituent such as a polystyrene, ABS resin, polycarbonate, polyethylene, or polypropylene constituent.

Fixed on both lengthwise ends of the development frame assembly 12 by a double-sided tape or the like are the elastic belt-shaped end seals (1) 14 and (2) 15 as previously mentioned (refer to FIG. 6).

Referring to FIG. 10, the positional relationship between the end seal (1) 14 and the end seal (2) 15 will now be described. FIG. 10 illustrates the positional relationship between the end seal (1) and the end seal (2) when the development frame assembly and the toner frame assembly have been coupled.

The end seals (1) 14 and (2) 15 on both ends of the development frame assembly 12 with the toner seal 13 sandwiched therebetween abut against the toner container 11*b*. At this time, the end seal (1) 14 and the end seal (2) 15 are in close contact with the toner container 11*b* with the toner seal 13 sandwiched therebetween due to the elasticity thereof (in a state where the end seals are compressed in thickness). The end seals (1) 14 and (2) 15 have the following two functions:

1. To prevent toner from leaking at the toner seal pull-out side or on the side of the end seal (2) 15 and at the opposite side or the side of the end seal (1) 14 when the toner seal 13 is pulled out and the toner is discharged from the toner container 11*b* to the development member 12*b*.

2. To prevent toner from coming out or spouting from the toner container 11*b* when the toner seal 13 is pulled out. When the toner seal 13 is pulled out and the portion, where the toner is already on, of the sealant surface (the surface facing the toner discharge opening 11*c*) of the toner seal 13 that has hermetically sealed the toner discharge opening 11*c* is pulled out passing the end seal (2) 15, the end seal (2) 15 would remove the toner adhering to the portion. As a result, the toner would come out together with the toner seal 13.

Hitherto, if the process cartridge B is stored in a storage environment with high temperature and high humidity, pseudo adhesion takes place between the sealant surface of the pull-out portion 13*b* of the toner seal 13 and the end seals (1) 14 and (2) 15, causing increased sliding strength or opening strength of the toner seal 13 in some cases. The strength is especially high at pulling start. Normal tensile strength required ranges from 39 N to 54 N (in the range of 4 to 5 kgf), whereas a tensile strength of 68 N to 80 N (in the range of 7 to 8 kgf) is sometimes required to pull out the toner seal 13.

In this case, once the toner seal 13 starts to peel, the sliding strength or the opening strength of the sealant surface with which the toner does not come in direct contact ranges from maximum 29 N to 40 N (in the range of 3 to 4 kgf), posing no particular serious problem. The ease of opening, however, is obviously deteriorated when compared with the normal opening strength, 20 N (on the order of 2 kgf).

In the sealant surface of the toner seal 13, the toner adheres to the portion where the sealant surface is in contact with the toner in the toner container 11*b*. Hence, when the portion slides in contact with the end seal (2) 15, the toner exists between the end seal (2) 15 and the toner seal 13; therefore, the sliding strength or the opening strength lies almost in the normal range, 10 N to 20 N (in the range of 1 to 2 kgf).

The embodiment is intended to solve the following problems with the conventional art:

1. High initial sliding strength or opening strength at the start of peeling of the toner seal 13 when the toner seal 13 is pulled out.

2. High opening strength until the portion of the sealant surface where toner has adhered reaches the end seal (2) 15.

Figure 10A:
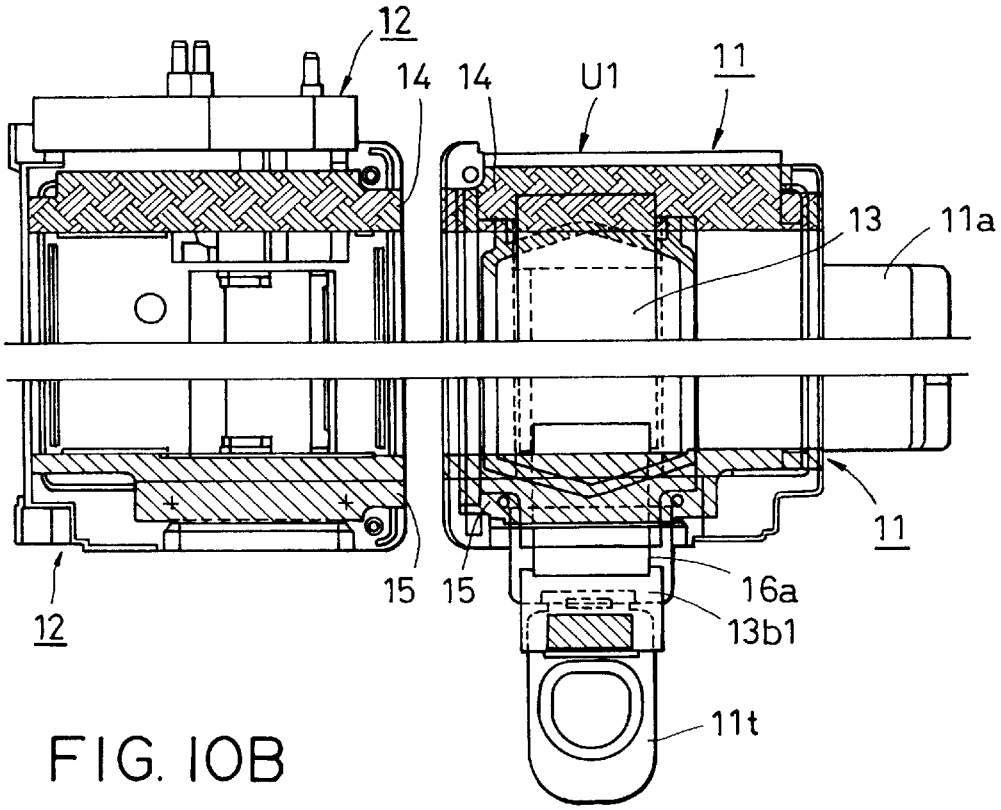
FIG. 10A shows the positional relationship between the end seal (1) and the end seal (2) in accordance with the first embodiment.

To solve the above problems, a filmy low-friction member 16*a* is disposed on a portion, which comes in contact with the end seal (2) 15 at the start of pulling out the toner seal, of the sealant surface of the toner seal 13, and on the areas over 5 to 15 mm on the upstream and downstream sides of the aforesaid portion as shown in FIG. 10A.

Figure 10B:
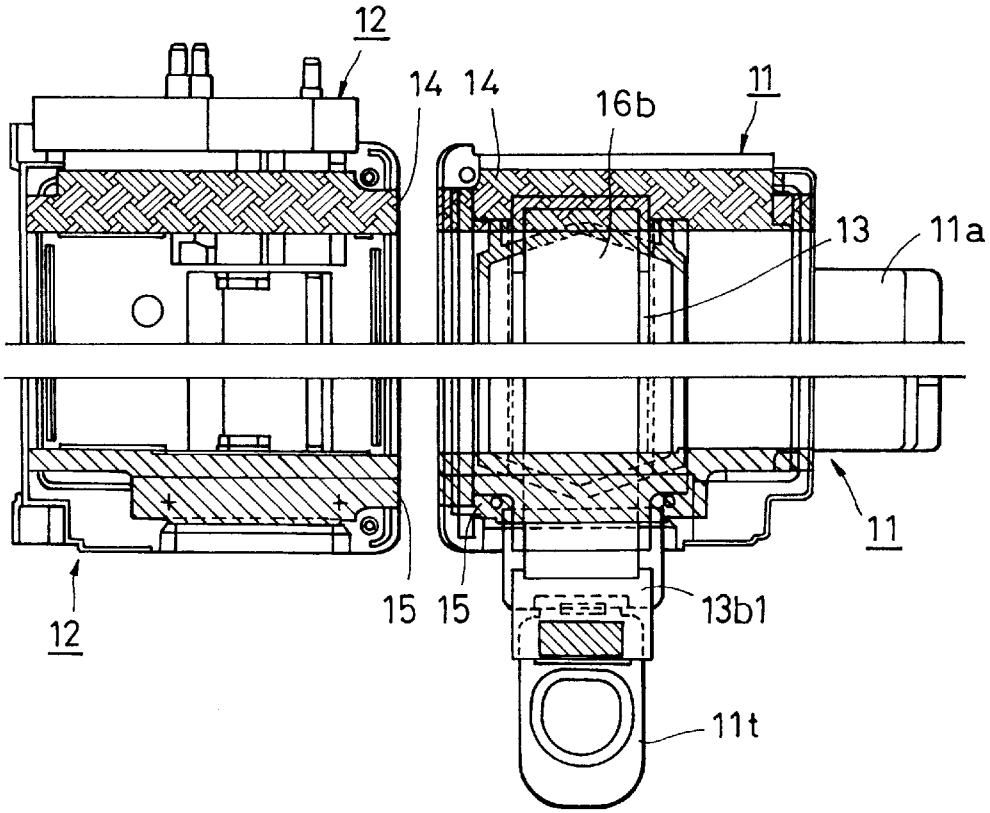
FIG. 10B shows the positional relationship between the end seal (1) and the end seal (2) in accordance with the second embodiment.

Further, as shown in FIG. 10B, a filmy low-friction member 16*b* is disposed on the entire lengthwise area of the sealant surface of the toner seal 13 that is opposed to the end seals (1) 14 and (2) 15, extending over the area from the end seal (1) 14 to the end seal (2) 15 fixed to the development frame assembly 12.

When disposing the low-friction members 16*a* and 16*b* on the sealant surface of the toner seal 13, the lateral dimension of the low-friction member 16*b* is preferably 75% or more but below 100% of the lateral dimension of the toner seal 13.

[Measurement and Assessment of Sliding Strength at Removing Toner Seal]

In the embodiment, the sliding strength or opening strength encountered at the time of pulling out the toner seal 13 has been measured to check for the effect of reducing the opening strength of the toner seal 13. The following will describe the measurement conditions and procedures.

In Table 1 through Table 4 given below, "Embodiment 1" refers to the developing unit U1 shown FIG. 10A wherein the low-friction member 16*a* is disposed on the portion where the end seal (2) 15 on the sealant surface of the toner seal 13 is abutted against the toner frame assembly 11. Likewise, "Embodiment 2" refers to the developing unit U1 shown in FIG. 10B wherein the low-friction member 16*b* is disposed on the entire lengthwise area of the sealant surface of the toner seal 13 opposed to the end seals (1) 14 and (2) 15, over the area from the end seal (1) 14 to the end seal (2) 15 fixed to the development frame assembly 12.

The material used for the low-friction members 16*a* and 16*b* is an adhesive tape of a polyester base material (hereinafter referred to as "PET") that is 0.07 mm thick. To be more specific, the adhesive tape is made by Nitto Denko and is called "holding tape", which is mainly used for holding or packaging electrical products. The effectiveness for reducing the sliding strength or the opening strength has been checked on the following three different groups: the holding tapes with silicone-evaporated surfaces (see Embodiment 1, Embodiment 2, and Other embodiments Other 1 through Other 5 which represent other embodiments); holding tapes with no surface treatment in other embodiments Other 1 through Other 21 (see Other 6 through Other 9, and Other 12 through Other 19); and holding tapes or the low-friction members 16*a* and 16*b* of different materials (see Other 10 and Other 11).

The end seals (1) 14 and (2) 15 are formed of a spongy polyurethane constituent, more specifically, a constituent called "Moltopren" made by INOAC corporation.

When the end seals (1) 14 and (2) 15 are made using Moltopren and the toner seal 13 is sandwiched between the end seals and the toner container at both ends of the development frame assembly 12, the state wherein the end seals (1) 14 and (2) 15 are compressed thickness-wise will be represented in terms of numerical values as "crush amount" in the description given hereinafter.

$$\text{Crush amount} = \text{Thickness (mm) of compressed or contacted end seal} / \text{Thickness (mm) before compression or assembly}$$

The above expression is used to determine the crush amount. In this embodiment, the thickness after compression was fixed to 1 mm. The thickness before compression is preferably 2.5 to 4.5 mm, more preferably 2.8 to 3.3 mm, and most preferably 3 mm. In Embodiments 1 and 2, the thickness before compression was set to 3 mm. In the tables, thickness before compression in some Others was set to 2.5 mm (see Other 4 and Other 5), or 4.5 mm (see Other 2 and Other 3, and Other 14 through Other 21). Based on these dimensions, the crush amounts were calculated. Thus, smaller crush amounts indicate that the end seals (1) 14 and (2) 15 are compressed more, and the sliding strength or the opening strength of the toner seal 13 increases.

Figure 11A:
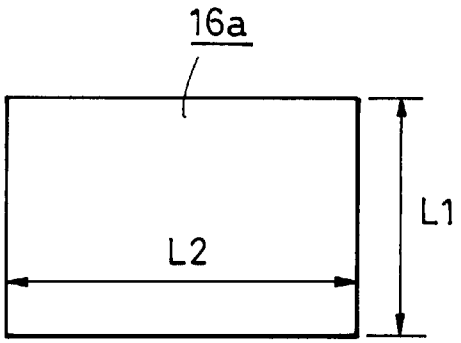
FIGS. 11A and 11B show the major dimensions of the low-friction member in accordance with the first embodiment and the low-friction member in accordance with the second embodiment.
Figure 11B:
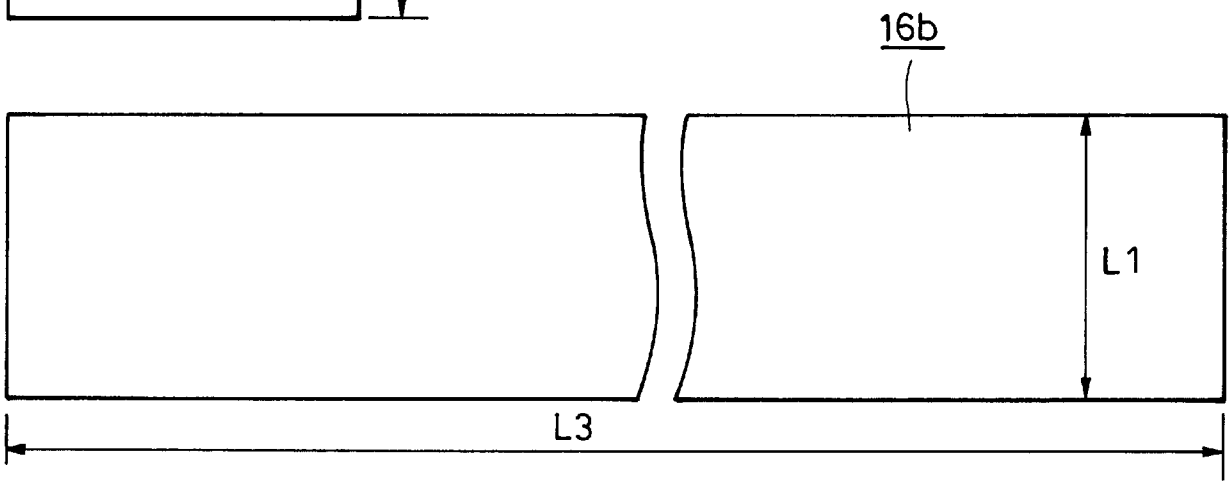

The following shows the major dimensions of the low-friction members 16*a* and 16*b*, the toner seal 13, and the end seals (1) 14 and (2) 15 in Embodiments 1 and 2 (see FIG. 11, FIG. 12, and FIG. 13).

| | |
|---|---|
| Common lateral dimensions of low-friction members 16a and 16b | (L1): 30 mm |
| Longitudinal dimension of low-friction member 16a | (L2): 40 mm |
| Longitudinal dimension of low-friction member 16b | (L3): 343 mm |
| Width of the toner seal 13 | (L4): 35 mm |
| Toner seal longitudinal contact dimension in end seal (1) 14 | (L5): 9 mm |
| Toner seal longitudinal contact dimension in end seal (2) 15 | (L6): 19 mm |
| Longitudinal dimension of toner discharge opening 11c | (L7): 301 mm |
| Lateral dimension of toner discharge opening 11c | (L8): 35 mm |
| Marginal dimension from toner seal end when low-friction member 16b is in use | (Lc): 2 mm (fixed) |
| Common thickness of end seals (1) 14 and (2) | (t): 3 mm |

Using the developing unit U1 shown above, the sliding strength or the opening strength of the toner seal 13 was checked. The measurement conditions and procedures are as shown below (see FIG. 14).

Checking procedure: The developing units U1 completed as cartridges were stored for one month under an environment of ordinary temperature (23° C.) and ordinary humidity (50%), and under another environment of a high temperature (40° C.) and a high humidity (95%). Then, the sliding strength or the opening strength (hereinafter referred to as "opening strength") was checked on the units.

Pulling speed for opening: 9000 mm/min.

Figure 14:
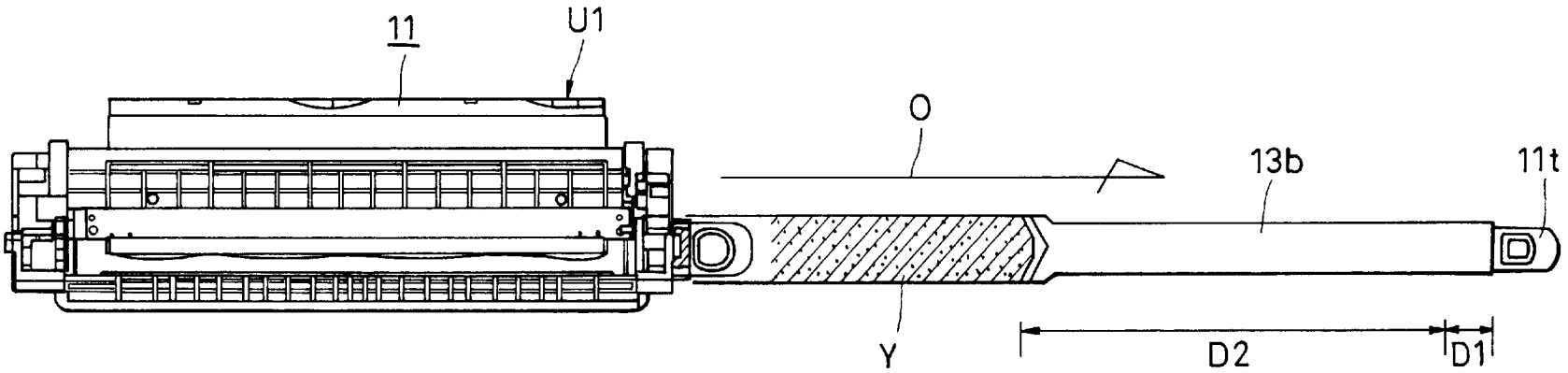
FIG. 14 shows how to pull out the toner seal and how to measure the opening strength.

Measurement: Pulled in a peeling direction 0 (almost straight, substantially horizontal) of the toner seal 13 to measure the maximum value of opening strength D1 at the pulling start and the maximum value of opening strength D2 until an area Y that seals the toner discharge opening 11*c* is exposed as illustrated in FIG. 14.

Then, the check was performed by assessment on "Maximum longitudinal contact dimension (15 mm) of toner seal 13 in end seal (1) 14", "Thickness of end seals (1) 14 and (2) 15", and "Materials of low-friction members 16*a* and 16*b*, and with/without treatment on contact surface" for each storage environment and the longitudinal dimension and the lateral dimension of the low-friction members 16*a* and 16*b*, respectively, in other embodiments.

The results are as shown in Tables 1 and 2 below. Tables 1 and 2 should be shown on the same one page; however, they are separately shown on different pages due to the limited space.

TABLE 1

| | | Low-Friction Member | | | | |
|---|---|---|---|---|---|---|
| | Storage Environment | Material | Surface Treatment | Longitudinal Dimension | Thickness | Lateral Dimension (Ratio to toner seal) |
| Conventional Example | Ordinary Temp/Humidity | | | Not Applicable | | |
| | High Temp/Humidity | | | Not Applicable | | |
| Embodiment | | | | | | |
| 1 | Ordinary Temp/Humidity | PET | Silicone | 40 mm | 0.07 mm | 30 mm (85.7%) |
| | High Temp/Humidity | PET | Silicone | 40 mm | 0.07 mm | 30 mm (85.7%) |
| 2 | Ordinary Temp/Humidity | PET | Silicone | 343 mm | 0.07 mm | 30 mm (85.7%) |
| | High Temp/Humidity | PET | Silicone | 343 mm | 0.07 mm | 30 mm (85.7%) |
| Other | | | | | | |
| 1 | Ordinary Temp/Humidity | PET | Silicone | 343 mm | 0.07 mm | 30 mm (85.7%) |
| | High Temp/Humidity | PET | Silicone | 343 mm | 0.07 mm | 30 mm (85.7%) |
| 2 | Ordinary Temp/Humidity | PET | Silicone | 40 mm | 0.07 mm | 30 mm (85.7%) |
| | High Temp/Humidity | PET | Silicone | 40 mm | 0.07 mm | 30 mm (85.7%) |
| 3 | Ordinary Temp/Humidity | PET | Silicone | 343 mm | 0.07 mm | 30 mm (85.7%) |
| | High Temp/Humidity | PET | Silicone | 343 mm | 0.07 mm | 30 mm (85.7%) |
| 4 | Ordinary Temp/Humidity | PET | Silicone | 40 mm | 0.07 mm | 30 mm (85.7%) |
| | High Temp/Humidity | PET | Silicone | 40 mm | 0.07 mm | 30 mm (85.7%) |
| 5 | Ordinary | PET | Silicone | 343 mm | 0.07 mm | 30 mm |

TABLE 1-continued

| | Storage Environment | Low-Friction Member | | | | |
|---|---|---|---|---|---|---|
| | | Material | Surface Treatment | Longitudinal Dimension | Thickness | Lateral Dimension (Ratio to toner seal) |
| | Temp/Humidity | | | | | (85.7%) |
| | High Temp/Humidity | PET | Silicone | 343 mm | 0.07 mm | 30 mm (85.7%) |
| 6 | Ordinary Temp/Humidity | PET | None | 40 mm | 0.07 mm | 30 mm (85.7%) |
| | High Temp/Humidity | PET | None | 40 mm | 0.07 mm | 30 mm (85.7%) |
| 7 | Ordinary Temp/Humidity | PET | None | 343 mm | 0.07 mm | 30 mm (85.7%) |
| | High Temp/Humidity | PET | None | 343 mm | 0.07 mm | 30 mm (85.7%) |
| 8 | Ordinary Temp/Humidity | PTFE (Fluorine) | None | 40 mm | 0.13 mm | 30 mm (85.7%) |
| | High Temp/Humidity | PTFE (Fluorine) | None | 40 mm | 0.13 mm | 30 mm (85.7%) |
| 9 | Ordinary Temp/Humidity | PTFE (Fluorine) | None | 343 mm | 0.13 mm | 30 mm (85.7%) |
| | High Temp/Humidity | PTFE (Fluorine) | None | 343 mm | 0.13 mm | 30 mm (85.7%) |
| 10 | Ordinary Temp/Humidity | Glass Cloth | PTFE | 40 mm | 0.13 mm | 30 mm (85.7%) |
| | High Temp/Humidity | Glass Cloth | PTFE | 40 mm | 0.13 mm | 30 mm (85.7%) |
| 11 | Ordinary Temp/Humidity | Glass Cloth | PTFE | 343 mm | 0.13 mm | 30 mm (85.7%) |
| | High Temp/Humidity | Glass Cloth | PTFE | 343 mm | 0.13 mm | 30 mm (85.7%) |
| 12 | Ordinary Temp/Humidity | Polypropylene | None | 40 mm | 0.15 mm | 30 mm (85.7%) |
| | High Temp/Humidity | Polypropylene | None | 40 mm | 0.15 mm | 30 mm (85.7%) |
| 13 | Ordinary Temp/Humidity | Polypropylene | None | 343 mm | 0.15 mm | 30 mm (85.7%) |
| | High Temp/Humidity | Polypropylene | None | 343 mm | 0.15 mm | 30 mm (85.7%) |
| 14 | Ordinary Temp/Humidity | Polypropylene | None | 40 mm | 0.15 mm | 30 mm (85.7%) |
| | High Temp/Humidity | Polypropylene | None | 40 mm | 0.15 mm | 30 mm (85.7%) |
| 15 | Ordinary Temp/Humidity | Polypropylene | None | 343 mm | 0.15 mm | 30 mm (85.7%) |
| | High Temp/Humidity | Polypropylene | None | 343 mm | 0.15 mm | 30 mm (85.7%) |
| 16 | Ordinary Temp/Humidity | Polypropylene | None | 40 mm | 0.15 mm | 26 mm (74.2%) |
| | High Temp/Humidity | Polypropylene | None | 40 mm | 0.15 mm | 26 mm (74.2%) |
| 17 | Ordinary Temp/Humidity | Polypropylene | None | 343 mm | 0.15 mm | 26 mm (74.2%) |
| | High Temp/Humidity | Polypropylene | None | 343 mm | 0.15 mm | 26 mm (74.2%) |
| 18 | Ordinary Temp/Humidity | Polypropylene | None | 40 mm | 0.15 mm | 25 mm (71.4%) |
| | High Temp/Humidity | Polypropylene | None | 40 mm | 0.15 mm | 25 mm (71.4%) |
| 19 | Ordinary Temp/Humidity | Polypropylene | None | 343 mm | 0.15 mm | 25 mm (71.4%) |
| | High Temp/Humidity | Polypropylene | None | 343 mm | 0.15 mm | 25 mm (71.4%) |
| 20 | Ordinary Temp/Humidity | Polypropylene | Apply Silicone oil | 40 mm | 0.15 mm | 30 mm (85.7%) |
| | High Temp/Humidity | Polypropylene | | 40 mm | 0.15 mm | 30 mm (85.7%) |
| 21 | Ordinary Temp/Humidity | Polypropylene | | 343 mm | 0.15 mm | 30 mm (85.7%) |
| | High Temp/Humidity | Polypropylene | | 343 mm | 0.15 mm | 30 mm (85.7%) |

Ratio to toner seal width 35 mm

When toner seal thickness is set to max. 0.244 for Others 16 and 17:

| | | | | | | |
|---|---|---|---|---|---|---|
| 22 | Ordinary Temp/Humidity | Polypro-pylene | None | 40 mm | 0.15 mm | 26 mm |
| | High Tamp/Humidity | Polypro-pylene | None | 40 mm | 0.15 mm | 26 mm |
| 23 | Ordinary Temp/Humidity | Polypro-pylene | None | 343 mm | 0.15 mm | 26 mm |
| | High Temp/Humidity | Polypro-pylene | None | 343 mm | 0.15 mm | 26 mm |
| 24 | Ordinary Temp/Humidity | Polypro-pylene | None | 40 mm | 0.15 mm | 26 mm |
| | High Temp/Humidity | Polypro-pylene | None | 40 mm | 0.15 mm | 26 mm |
| 25 | Ordinary Temp/Humidity | Polypro-pylene | None | 343 mm | 0.15 mm | 26 mm |
| | High Temp/Humidity | Polypro-pylene | None | 343 mm | 0.15 mm | 26 mm |

TABLE 2

| | End Seal (1) (2) Opening Strength (N(kgf)) | | | | | |
|---|---|---|---|---|---|---|
| | End Seal (1) Dimension 5 | Dimension t (Crush Amount) | D1 | D2 | Comparison Result | Remarks |
| Conventional Example | 9 mm | 3 mm (0.33) | 42.1 (4.3) | 34.3 (3.5) | Reference | |
| | 9 mm | 3 mm (0.33) | 68.6 (7.0) | 42.1 (4.3) | Reference | |
| Embodiment | | | | | | |
| 1 | Not Applicable | 3 mm (0.33) | 41.2 (4.2) | 33.3 (3.4) | Effective | Comparison with conventional example |
| | Not Aplicable | 3 mm (0.33) | 45.1 (4.6) | 37.2 (3.8) | | |
| 2 | 9 mm | 3 mm (0.33) | 41.2 (4.2) | 34.3 (3.5) | Effective | |
| | 9 mm | 3 mm (0.33) | 44.1 (4.5) | 35.3 (3.6) | | |
| Other | | | | | | |
| 1 | 15 mm | 3 mm (0.33) | 42.1 (4.3) | 34.3 (3.5) | Effective | Check was performed using maxim lengthwise contact dimension of toner seal in the end seal (A) in the embodiment. |
| | 15 mm | 3 mm (0.33) | 43.1 (4.4) | 35.3 (3.6) | | |
| 2 | Not Applicable | 4.5 mm (0.22) | 51.0 (5.2) | 42.1 (4.3) | Effective | End seal dimension t was increased. |
| | Not Applicable | 4.5 mm (0.22) | 53.9 (5.5) | 44.1 (4.5) | | |
| 3 | 9 mm | 4.5 mm (0.22) | 51.9 (5.3) | 41.2 (4.2) | Effective | |
| | 9 mm | 4.5 mm (0.22) | 52.9 (5.4) | 41.2 (4.2) | | |
| 4 | Not Applicable | 2.5 mm (0.4) | 36.3 (3.7) | 30.4 (3.1) | Effective | End seal dimension t was decreased → No problem such as toner leakage was observed. |
| | Not Applicable | 2.5 mm (0.4) | 39.2 (4.0) | 34.3 (3.5) | | |
| 5 | 9 mm | 2.5 mm (0.4) | 36.3 (3.7) | 27.4 (2.8) | Effective | |
| | 9 mm | 2.5 mm (0.4) (3.9) | 38.2 (2.8) | 27.4 | | |
| 6 | Not Applicable | 3 mm (0.33) | 44.1 (4.5) | 34.3 (3.5) | Effective | PET + No silicone treatment |
| | Not Applicable | 3 mm (0.33) | 46.1 (4.7) | 37.2 (3.6) | | |
| 7 | 9 mm | 3 mm (0.33) | 45.1 (4.6) | 36.3 (3.7) | Effective | |
| | 9 mm | 3 mm (0.33) | 45.1 (4.6) | 36.3 (3.6) | | |
| 8 | Not Applicable | 3 mm (0.33) | 39.2 (4.0) | 34.3 (3.5) | Effective | PET + Increased thickness |
| | Not Applicable | 3 mm (0.33) | 40.2 (4.1) | 36.3 (3.7) | | |
| 9 | 9 mm | 3 mm (0.33) | 38.2 | 28.4 | Effective | |

TABLE 2-continued

| | End Seal (1) (2) Opening Strength (N(kgf)) | | | | | |
|---|---|---|---|---|---|---|
| | End Seal (1) Dimension 5 | Dimension t (Crush Amount) | D1 | D2 | Comparison Result | Remarks |
| | | | (3.9) | (2.9) | | |
| | 9 mm | 3 mm (0.33) | 40.2 | 29.4 | | |
| | | | (4.1) | (3.0) | | |
| 10 | Not | 3 mm (0.33) | 39.2 | 34.3 | Effective | Material was changed |
| | Applicable | | (4.0) | (3.5) | | to glass cloth. |
| | Not | 3 mm (0.33) | 40.2 | 36.3 | | |
| | Applicable | | (4.1) | (3.7) | | |
| 11 | 9 mm | 3 mm (0.33) | 38.2 | 29.4 | Effective | |
| | | | (3.9) | (3.0) | | |
| | 9 mm | 3 mm (0.33) | 39.2 | 29.4 | | |
| | | | (4.0) | (3.0) | | |
| 12 | Not | 3 mm (0.33) | 51.0 | 44.1 | Effective | Polypropylene + |
| | Applicable | | (5.2) | (4.5) | | Further increased |
| | Not | 3 mm (0.33) | 53.9 | 46.1 | | thickness. |
| | Applicable | | (5.5) | (4.7) | | |
| 13 | 9 mm | 3 mm (0.33) | 51.9 | 45.1 | Effective | |
| | | | (5.3) | (4.6) | | |
| | 9 mm | 3 mm (0.33) | 52.9 | 46.1 | | |
| | | | (5.4) | (4.7) | | |
| 14 | Not | 4.5 mm (0.22) | 55.9 | 49.0 | Effective | Polypropylene + End seal |
| | Applicable | | (5.7) | (5.0) | | thickness is also |
| | Not | 4.5 mm (0.22) | 57.8 | 50.0 | | increased (The second |
| | Applicable | | (5.9) | (5.1) | | most stringent |
| 15 | 9 mm | 4.5 mm (0.22) | 59.8 | 51.0 | Effective | conditions in type of |
| | | | (6.1) | (5.2) | | material and |
| | 9 mm | 4.5 mm (0.22) | 58.8 | 51.0 | | dimensions when |
| | | | (6.0) | (5.2) | | polypropylene is used |
| | | | | | | in the embodiments). |
| 16 | Not | 4.5 mm (0.22) | 60.8 | 51.0 | Effective | Polypropylene + End |
| | Applicable | | (6.2) | (5.2) | | seal thickness is also |
| | Not | 4.5 mm (0.22) | 62.7 | 51.0 | | increased (The most |
| | Applicable | | (6.4) | (5.2) | | stringent conditions |
| 17 | 9 mm | 4.5 mm (0.22) | 61.7 | 50.0 | Effective | in type of material |
| | | | (6.3) | (5.1) | | and dimensions when |
| | 9 mm | 4.5 mm (0.22) | 62.7 | 51.9 | | polypropylene is used |
| | | | (6.4) | (5.3) | | in the embodiments). |
| 18 | Not | 4.5 mm (0.22) | 63.7 | 55.9 | Slightly | The most stringent |
| | Applicable | | (6.5) | (5.7) | effective | conditions in the type |
| | Not | 4.5 mm (0.22) | 67.6 | 64.7 | | of material and |
| | Applicable | | (6.9) | (6.6) | | dimensions among the |
| 19 | 9 mm | 4.5 mm (0.22) | 62.7 | 51.0 | Slightly | embodiments were used |
| | | | (6.4) | (5.2) | effective | to check the lower |
| | 9 mm | 4.5 mm (0.22) | 64.7 | 51.9 | | limitation of the |
| | | | (6.6) | (5.3) | | lateral dimension of |
| | | | | | | ther low-friction |
| | | | | | | member. |
| 20 | Not | 4.5 mm (0.22) | 49.0 | 44.1 | Effective | Silicone oil was |
| | Applicable | | (5.0) | (4.5) | | applied to the low- |
| | Not | 4.5 mm (0.22) | 51.0 | 45.1 | | friction members of |
| | Applicable | | (5.2) | (4.6) | | Others 14 and 15. |
| 21 | 9 mm | 4.5 mm (0.22) | 49.0 | 42.1 | Effective | |
| | | | (5.0) | (4.3) | | |
| | 9 mm | 4.5 mm (0.22) | 50.0 | 43.1 | | |
| | | | (5.1) | (4.4) | | |
| 22 | Not | 4.5 mm | 61.7 | 51.0 | Effective | Max. toner seal |
| | Applicable | | (6.3) | (5.2) | | thickness (0.245 mm) was |
| | Not | 4.5 mm | 62.7 | 51.9 | | applied to Others 16 |
| | Applicable | | (6.4) | (5.3) | | and 17. → No |
| 23 | 9 mm | 4.5 mm | 62.7 | 51.0 | Effective | noticeable change in |
| | | | (6.4) | (5.2) | | strength was observed |
| | 9 mm | 4.5 mm | 61.7 | 51.9 | | after the toner seal |
| | | | (6.3) | 5.3) | | thickness was changed. |
| 24 | Not | 4.5 mm | 60.8 | 50.0 | Effective | |
| | Applicable | | (6.2) | (5.1) | | |
| | Not | 4.5 mm | 61.7 | 50.0 | | |
| | | | (6.3) | (5.1) | | |
| 25 | 9 mm | 4.5 mm | 60.8 | 51.0 | Effective | |
| | | | (6.2) | (5.2) | | |
| | 9 mm | 4.5 mm | 61.7 | 50.0 | | |
| | | | (6.3) | (5.1) | | |

As can be seen from Tables 1 and 2, it has been found that the opening strength of all embodiments, which have the 3-mm crush amount and the silicone-coated surfaces on the holding tapes serving as the low-friction members 16*a* and

16*b* (Embodiment 1, Embodiment 2, and Other 1 through Other 5), can be effectively reduced as compared with the conventional comparison examples, with no noticeable problem in the opening operation having been presented. Furthermore, as shown in Tables 3 and 4 given below, the check was conducted also on other materials used for the low-friction members 16*a* and 16*b*. It has been revealed that all the materials shown in Tables 1 through 4 effectively reduce the opening strength at least up to a thickness of 0.15 mm. If the thickness of the low-friction members is reduced to a value below 0.03 mm, then it would be difficult to dispose the low-friction members because they are apt to be dislocated or turned over, or if they are formed of an adhesive tape, then bubbles or wrinkles may be produced in some cases. For this reason, the thickness of the low-friction members 16*a* and 16*b* preferably ranges from 0.03 mm to 0.15 mm.

Incidentally, the results shown in Tables 3 and 4 indicate that the polypropylene PP constituent exhibits the highest opening strength, and shows the highest value, 50.0 N, among the embodiments even when the thickness is set to 0.065 mm. After all, however, the polypropylene (PP) constituent has proven effective over the conventional comparison example which showed 68.6 N; it has also proven competitively effective (53.9 N) even with the thickness of 0.15 mm. Tables 3 and 4 should be given on the same page; however, they are shown on separate pages due to the limited space.

The opening strength was checked in the same manner by setting the thickness of the toner seal to 0.245 mm (the maximum value in the embodiments) in Others 22 and 23. It has been found that the opening strength hardly changes or at least it is not increased, up to the thickness of 0.245 mm.

On the other hand, the opening strength was checked in the same manner by setting the thickness of the toner seal to 0.095 mm (the minimum value in the embodiments) in Others 24 and 25. It has been found that the opening strength hardly changes at least up to 0.095 mm.

TABLE 3

(Comparing Strength of Each Material for Low-Friction Member)

| | Storage Environment | Low-Friction Member | | | | |
|---|---|---|---|---|---|---|
| | | Material | Surface Treatment | Longitudinal Dimension | Thickness | Lateral Dimension (Ratio to toner seal) |
| Conventional Example | Ordinary Temp/Humidity | | | Not Applicable | | |
| | High Temp/Humidity | | | Not Applicable | | |
| Embodiment 1 | High Temp/Humidity | PET | Silicone | 40 mm | 0.07 mm | 30 mm (85.7%) |
| Other 8 | High Temp/Humidity | PTFE (Fluorine) | None | 40 mm | 0.13 mm | 30 mm (85.7%) |
| 8 in different thickness | High Temp/Humidity | PTFE (Fluorine) | None | 40 mm | 0.18 mm | 30 mm (85.7%) |
| 20 | High Temp/Humidity | HDPE | None | 40 mm | 0.09 mm | 30 mm (85.7%) |
| 21 | High Temp/Humidity | Tedler | None | 40 mm | 0.09 mm | 30 mm (85.7%) |
| 22 | High Temp/Humidity | Aluminum foil | None | 40 mm | 0.09 mm | 30 mm (85.7%) |
| 23 | High Temp/Humidity | Glass cloth | None | 40 mm | 0.13 mm | 30 mm (85.7%) |
| 24 | High Temp/Humidity | Crepe paper | None | 40 mm | 0.15 mm | 30 mm (85.7%) |
| 25 | High Temp/Humidity | PE cloth | None | 40 mm | 0.13 mm | 30 mm (85.7%) |
| 26 | High Temp/Humidity | Nomex paper | None | 40 mm | 0.09 mm | 30 mm (85.7%) |
| 27 | High Temp/Humidity | PPS | None | 40 mm | 0.05 mm | 30 mm (85.7%) |
| 28 | High Temp/Humidity | Unwoven fabric | None | 40 mm | 0.15 mm | 30 mm (85.7%) |
| 18 | High Temp/Humidity | OA paper | None | 40 mm | 0.15 mm | 30 mm (85.7%) |
| 6 | High Temp/Humidity | PET | None | 40 mm | 0.07 mm | 30 mm (85.7%) |
| 29 | High Temp/Humidity | Vinyl | None | 40 mm | 0.13 mm | 30 mm (85.7%) |
| 30 | High Temp/Humidity | Kapton | None | 40 mm | 0.07 mm | 30 mm (85.7%) |
| 31 | High Temp/Humidity | Polyimide | None | 40 mm | 0.08 mm | 30 mm (85.7%) |
| 12 | High Temp/Humidity | Polypro-pylene | None | 40 mm | 0.15 mm | 30 mm (85.7%) |
| 12 in different thickness | High Temp/Humidity | Polypro-pylene | None | 40 mm | 0.085 mm | 30 mm (85.7%) |

TABLE 3-continued (Comparing Strength of Each Material for Low-Friction Member)

| | | Low-Friction Member | | | | |
|---|---|---|---|---|---|---|
| | Storage Environment | Material | Surface Treatment | Longitudinal Dimension | Thickness | Lateral Dimension (Ratio to toner seal) |
| 32 | High Temp/Humidity | Ultrahigh Molecular Weight Polyethylene | None | 40 mm | 0.13 mm | 30 mm (85.7%) |
| | | | | Ratio to toner seal width 35 mm | | |

Abbreviations of Material Names
PE cloth: Polyethylene cloth
PPS: Polyphenylene sulfide

TABLE 4

| | End seal (1) (2) | | Opening Strength (N(kgf)) | | |
|---|---|---|---|---|---|
| | End Seal (1) Dimension 5 | Dimension t (Crush Amount) | D1 | Comparison Result | Remarks |
| Conventional | 9 mm | 3 mm (0.33) | 42.1 (4.3) | Object | |
| Example | 9 mm | 3 mm (0.33) | 68.6 (7.0) | Object | |
| Embodiment 1 | Not Applicable | 3 mm (0.33) | 45.1 (4.6) | Effective | |
| Other 8 | Not Applicable | 3 mm (0.33) | 40.2 (4.1) | Effective | ←When the material was changed with "no surface treatment, "polytetra fluoroethylene (PTFE) exhibited the lowest strength. *The most typical thickness was selected for each low-friction member. It has been found that, among all the embodiments of the present invention, polypropylene (PP) exhibited the highest sliding strength or opening strength, and that all materials included in the table can be applied up to the thickness of 0.15 mm. |
| 8 in different thickness | Not Applicable | 3 mm (0.33) | 41.2 (4.2) | Effective | |
| 20 | Not Applicable | 3 mm (0.33) | 41.2 (4.2) | Effective | |
| 21 | Not Applicable | 3 mm (0.33) | 41.2 (4.2) | Effective | |
| 22 | Not Applicable | 3 mm (0.33) | 42.1 (4.3) | Effective | |
| 23 | Not Applicable | 3 mm (0.33) | 43.1 (4.4) | Effective | |
| 24 | Not Applicable | 3 mm (0.33) | 43.1 (4.4) | Effective | |
| 25 | Not Applicable | 3 mm (0.33) | 44.1 (4.5) | Effective | |
| 26 | Not Applicable | 3 mm (0.33) | 44.1 (4.5) | Effective | |
| 27 | Not Applicable | 3 mm (0.33) | 44.1 (4.5) | Effective | |
| 28 | Not Applicable | 3 mm (0.33) | 45.1 (4.6) | Effective | |
| 18 | Not Applicable | 3 mm (0.33) | 46.1 (4.7) | Effective | |
| 6 | Not Applicable | 3 mm (0.33) | 46.1 (4.7) | Effective | |
| 29 | Not Applicable | 3 mm (0.33) | 47.0 (4.8) | Effective | |
| 30 | Not Applicable | 3 mm (0.33) | 49.0 (5.0) | Effective | |
| 31 | Not Applicable | 3 mm (0.33) | 50.0 (5.1) | Effective | |
| 12 | Not Applicable | 3 mm (0.33) | 53.9 (5.5) | Effective | |
| 12 in different thicknesses | Not Applicable | 3 mm (0.33) | 50.0 (5.1) | Effective | |
| 32 | Not Applicable | 3 mm (0.33) | 40.2 (4.1) | Effective | ←The ultrahigh molecular weight polyethylene showed the same results as hose of PTFE. |

Thus, compared with the conventional comparison examples, the development unit U1 of the embodiment has proved that the provision of the low-friction members 16*a* and 16*b* is effective in controlling an increase in the sliding strength, i.e., the opening strength of the toner seal 13, in an environment of high temperature and high humidity. In particular, the versions with silicone coated on the surfaces of the low-friction members 16*a* and 16*b* (Embodiment 1 through Other 5 in Tables 1 and 2), the versions provided with polytetrafluoroethylene (PTFE) coating (Other 10 and Other 11 in Tables 1 and 2), and the versions using a fluorocarbon resin such as PTFE as its material (Other 8 and Other 9 in Tables 1 and 2) have proven to be able to further reduce the opening strength and exhibit stable opening strength independently of different storage environments.

An equivalent advantage has been observed also with the versions having silicone oil applied thereto (Other 20 and Other 21 in Tables 1 and 2). In the embodiment, the silicone oil has been applied to the low-friction members 16*a* and 16*b*. In this case, the same advantage has been obtained when the silicone oil was applied to the end seals (1) 14 and (2) 15.

There are no particular restrictions on the materials for the embodiment mentioned above as long as they impart low-resistance sliding properties to the surfaces abutted against the end seals (1) 14 and (2) 15. Such materials include high-density polyethylene (HDPE), Tedler, aluminum foil, glass cloth, crepe paper, polyethylene cloth, Nomex paper, polyphenylenesulfide (PPS), unwoven fabric, vinyl, Kapton, polyimide (PI), and ultrahigh molecular weight polyethylene shown in Tables 3 and 4.

Second Embodiment

The second embodiment exemplifies a developer accommodating container used for replenishing toner to the developing device of the image forming apparatus main body of an electrophotographic image forming apparatus of a copier or the like.

Figure 15:
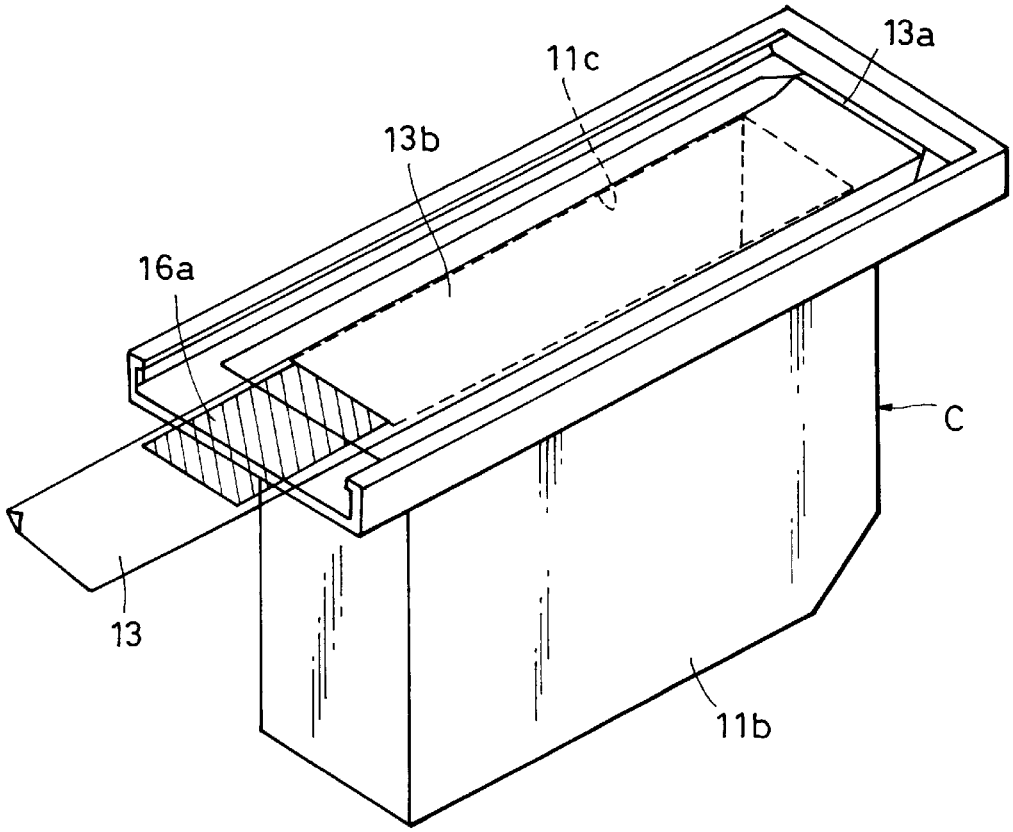
FIG. 15 is a perspective view of the toner container in accordance with the second embodiment.
Figure 16:
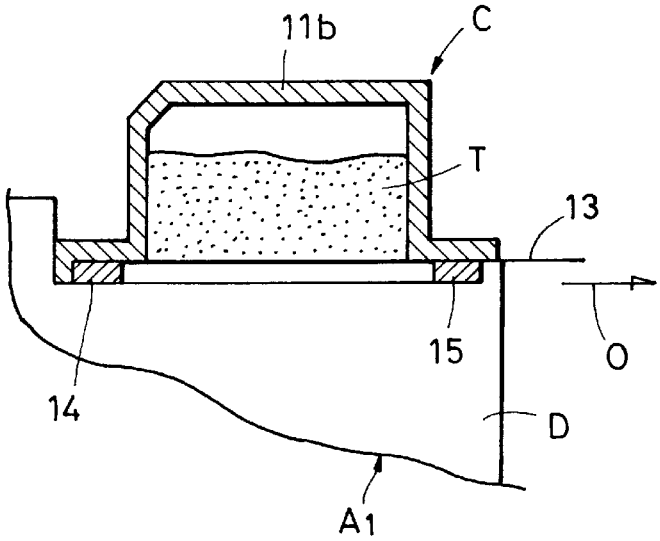
FIG. 16 is a schematic sectional view of the toner container mounted on the main body of an image forming apparatus.

FIG. 15 is a perspective view of the developer accommodating container in accordance with the second embodiment. FIG. 16 is a schematic sectional view illustrative of a state wherein the developer accommodating container, which can be detachably mounted on the image forming apparatus main body, has been installed on the image forming apparatus main body.

Referring to FIG. 15, a developer accommodating container C includes a toner container 11*b* serving as the container main body for accommodating toner T, a toner discharge opening 11*c* formed in the toner container 11*b*, a toner seal 13, one lengthwise end 13*a* of the toner seal, a pull-out end 13*b* formed by folding the toner seal back, and a low-friction member 16*a*.

Referring to FIG. 16, an image forming apparatus main body A1 of an electrophotographic image forming apparatus of a copier or the like includes a hopper container or development assembly D of the developing device of the image forming apparatus main body A1 on which the developer accommodating container C is mounted, and end seals 14 and 15 disposed on the hopper container D such that they are opposed to both lengthwise ends of the toner seal 13 of the developer accommodating container C.

As in the case of the first embodiment described above, the developer accommodating container C of the second embodiment has also the low-friction member 16*a* disposed on the portion of the sealant surface of the toner seal 13 where the end seal 15 comes in contact with the toner container 11*b*, and also on the areas extending over 5 to 15 mm preceding and following the foregoing portion.

The developer accommodating container C having the configuration described above is mounted on the hopper container D such that the end seals 14 and 15 of the hopper container D are opposed to the toner seal 13 of the toner container 11*b* as shown in FIG. 16. At this time, the end seals 14 and 15 are held against the toner container 11*b* with the toner seal 13 sandwiched therebetween. The toner seal 13 is pulled in the direction of 0 to permit the toner in the toner container 11*b* to be supplied to the hopper container D.

As in the case of the example shown in FIG. 9B in the first embodiment, the low-friction member 16*b* may alternatively be disposed on the entire lengthwise area of the sealant surface of the toner seal 13 opposed to the end seals 14 and 15, over the area from the end seal 14 to the end seal 15 fixed to the hopper container D.

In the developer accommodating container C in accordance with the second embodiment also, the sliding strength or the opening strength of the toner seal 13 was measured and checked according to the same checking procedures as those in the first embodiment. The dimensions and the positional relationships of the toner seal 13, the end seals 14 and 15, and the low-friction members 16*a* and 16*b* are exactly the same as those of the first embodiment.

It has been found that the same results as those shown in Tables 1 through 4 apply to the opening strength and the effect of the low-friction members.

Thus, the process cartridge B and the developer accommodating container C in accordance with the embodiments described above provide the following advantages:

1. The low-friction members 16*a* or 16*b* has been disposed at the pull-out portion 13*b* of the sealant surface of the toner seal 13; therefore, the sliding strength or the opening strength required for pulling out the toner seal 13 can be reduced, and an increase in the opening strength after extended storage in an environment of high temperature and high humidity can be also suppressed.

2. The flexibility of the filmy toner seal 13 permits uniform sliding strength and therefore stable opening operation.

3. The low-friction member 16*a* has been disposed at the portion where the end seal 15 provided on the development assembly 12*b* or D is abutted against the sealant surface of the toner seal 13 when pulling out the toner seal 13, at least on the side from which the toner seal 13 is pulled out. Hence, the strength at the pulling start at which the sliding strength or the opening strength is the highest can be reduced, and an increase in the opening strength after extended storage in an environment of high temperature and high humidity can be also controlled.

4. The low-friction member 16*a* has been disposed at the portion where the end seal 15 provided on the development assembly 12*b* or D is abutted against the sealant surface of the toner seal 13 when the toner seal 13 is pulled out, and also disposed on the areas extending 5 to 15 mm preceding and following the aforesaid abutted area, at least on the side from which the toner seal 13 is pulled out. This makes it possible to prevent the abutted portion from being dislocated, thus permitting the low-friction member 16*a* to be securely disposed.

5. On the surface of the toner seal 13, which surface is abutted against the toner discharge opening 11*c*, the low-friction member 16*b* has been disposed on the entire lengthwise area of the sealant surface of the toner seal 13 facing the development assembly 12*b* or D that does not directly hermetically seal the toner discharge opening 11*c*. This makes it possible to reduce the opening strength at the start of pulling the toner seal 13 and also the sliding strength or the opening strength in the middle of pulling out the toner seal, thus permitting easier pulling out of the toner seal.

6. The low-friction members 16*a* and 16*b* are filmy to provide flexibility. This completely eliminates the possibility of the low-friction member 16*a* or 16*b* itself interfering with the pulling out of the toner seal 13 with resultant slightly increased opening strength. Thus, further stable opening operation can be achieved.

7. The thickness of the low-friction members 16*a* and 16*b* is set to 0.03 mm or more, but less than 0.15 mm. Hence, the presence of the low-friction member 16*a* or 16*b* at the area of the toner seal 13 that is abutted against the end seals 14 and 15 does not cause the process cartridge B or the developer accommodating container C to incur a considerable increase in the sliding strength when pulling out the toner seal 13 after prolonged storage of in an environment of high temperature and high humidity, thus permitting further stable opening operation.

8. The constituent of at least the surfaces of the low-friction members 16*a* and 16*b* is formed of polyester (PET), polytetrafluoroethylene (PTFE), glass cloth, polypropylene (PP), high-density polyethylene (HDPE), vinyl, crepe paper, polyethylene (PE), Kapton, unwoven fabric, Nomex paper, polyphenylenesulfide (PPS), polyimide (PI), or ultrahigh molecular weight polyethylene. Hence, the presence of the low-friction member 16*a* or 16*b* at the area of the toner seal 13 that is abutted against the end seals 14 and 15 does not cause the process cartridge B or the developer accommodating container C to incur a considerable increase in the sliding strength when pulling out the toner seal 13 after prolonged storage of in an environment of high temperature and high humidity, thus permitting further stable opening operation.

9. The low-friction members 16*a* and 16*b* are formed of adhesive tapes, so that the low-friction members 16*a* and 16*b* do not drop at the time of pulling out the toner seal. This eliminates the possibility of an extra step for picking up dropped low-friction member 16*a* or 16*b*. Moreover, in the manufacture of the developing unit U1 of the process cartridge B or the developer accommodating container C, the possibility of the low-friction member 16*a* or 16*b* being dislocated can be eliminated during or after an assembly step.

10. The lateral dimensions of the low-friction members 16*a* and 16*b* are set to 75% or more but below 100% of the lateral dimension of the toner seal. Therefore, the adhesive surfaces of the low-friction members 16*a* and 16*b* do not extend beyond the toner seal 13 when completing the assembly. As a result, an increase or variation in the sliding strength or opening strength due to the adhesive surfaces extending beyond the toner seal can be controlled, thus permitting further stable opening operation.

11. The surfaces of the low-friction members, namely, the surfaces abutted against the end seals 14 and 15 of the development assembly 12*b* or D, are provided with the silicone coating, the coating of polytetrafluoroethylene (PTFE), or the silicone oil. This further reduces the sliding strength or the opening strength and also further limits an increase in the opening strength after a prolonged storage in an environment of high temperature and high humidity.

What is claimed is:

1. A developer accommodating container comprising:

a container main body for accommodating a developer, said container main body having an opening through which the developer is supplied to a development container; and a sealing member which seals said opening and can be pulled out to open said opening, said sealing member having a sealant surface fixed to said container main body;

wherein said sealing member is pressed by an end seal provided on an end on a side, from which said sealing member is pulled out, to prevent the developer adhering to said sealing member from leaking out when said sealing member is pulled out, and a surface of said sealing member which is provided with said sealant surface has an area with a friction coefficient smaller than that of said sealant surface, said area being located in a portion that comes in contact with said end seal at the beginning of pulling out said sealing member.

2. A developer accommodating container according to claim 1, wherein said development container is provided on an image forming apparatus main body, and said developer accommodating container is detachably mounted on said image forming apparatus main body.

3. A developer accommodating container according to claim 1, wherein the surface of said sealing member that is provided with said sealant surface has said area with a smaller friction coefficient extending over 5 to 15 mm from an upstream side to a downstream side in relation to a direction in which said sealing member is pulled out, said area being located in the portion that comes in contact with said end seal at the beginning of pulling out said sealing member.

4. A developer accommodating container according to claim 1, wherein said area with a smaller friction coefficient is formed by a part of a portion that extends beyond a portion covering said opening of said sealing member and is folded back.

5. A developer accommodating container according to claim 4, wherein said sealing member is pulled out in a lengthwise direction thereof, said end seals are provided on both ends arranged in a pulling-out direction, and said area with a smaller friction coefficient is provided such that it extends between said either end along the length of said sealing member.

6. A developer accommodating container according to claim 4, wherein said sealing member is pulled out in a lengthwise direction thereof, said end seals are provided on both ends arranged in the pulling-out direction, and said area with a smaller friction coefficient is provided such that it comes in contact only with the end seal, out of said both end seals, that is located on the downstream side in relation to said pulling-out direction.

7. A developer accommodating container according to claim 1, wherein said sealing member is filmy.

8. A developer accommodating container according to claim 7, wherein the thickness of said area with a smaller friction coefficient ranges from 0.03 to 0.15 mm.

9. A developer accommodating container according to claim 1, wherein said sealing member is pulled out in the lengthwise direction thereof, and the lateral dimension of said area with a smaller friction coefficient is 75% or more but below 100% of the lateral dimension of said sealing member.

10. A developing device comprising:

a development container equipped with a developer bearing member that carries a developer to a development position;

a container main body for accommodating the developer, said container main body having an opening through which the developer is supplied to said development container; and a sealing member which seals said opening and can be pulled out to open said opening, said sealing member having a sealant surface fixed to said container main body;

an end seal which presses said sealing member to prevent the developer adhering to said sealing member from leaking out when said sealing member is pulled out, and which is provided on an end of said container main body, the end being on a pulling-out side;

wherein a surface of said sealing member that is provided with said sealant surface has an area with a friction coefficient smaller than that of said sealant surface, said area being located in a portion that comes in contact with said end seal at the beginning of pulling out said sealing member.

11. A developing device according to claim 10, wherein said surface of said sealing member that is provided with said sealant surface has said area with a smaller friction coefficient extending over 5 to 15 mm from an upstream side to a downstream side in relation to a direction in which said sealing member is pulled out, said area being located in a portion that comes in contact with said end seal at the beginning of pulling out said sealing member.

12. A developing device according to claim 10, wherein said area with a smaller friction coefficient is formed by a part of a portion that extends beyond a portion covering said opening of said sealing member and is folded back.

13. A developing device according to claim 12, wherein said sealing member is pulled out in a lengthwise direction thereof, said end seals are provided on both ends arranged in the pulling-out direction, and said area with a smaller friction coefficient is provided such that it extends between said both ends along the length of said sealing member.

14. A developing device according to claim 12, wherein said sealing member is pulled out in a lengthwise direction thereof, said end seals are provided on both ends in the pulling-out direction, and said area with a smaller friction coefficient is provided such that it comes in contact only with the end seal, out of said both end seals, on the downstream side in relation to said pulling-out direction.

15. A developing device according to claim 10, wherein said sealing member is filmy.

16. A developing device according to claim 15, wherein thickness of said area with a smaller friction efficient ranges from 0.03 to 0.15 mm.

17. A developing device according to claim 10, wherein said sealing member is pulled out in the lengthwise direction thereof, and the lateral dimension of said area with a smaller friction coefficient is 75% or more but below 100% of the lateral dimension of said sealing member.

18. A developing device according to any one of claims 10 to 17, wherein said developing device constitutes, in operation with an image bearing member, a process cartridge that can be detachably mounted on an image forming apparatus.

* * * * *

UNITED STATES PATENT AND TRADEMARK OFFICE

CERTIFICATE OF CORRECTION

PATENT NO. : 6,088,552
DATED : July 11, 2000
INVENTOR(S) : Hiroumi Morinaga et al.

It is certified that error appears in the above-identified patent and that said Letters Patent is hereby corrected as shown below:

This certificate supersedes Certificate of Correction issued June 4, 2002. The certificate was issued in error and should be deleted.

Signed and Sealed this

Sixteenth Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,088,552
DATED : June 3, 1999
INVENTOR(S) : Hiroumi Morinaga et al.

It is certified that error appears in the above-identified patent and that said Letters Patent is hereby corrected as shown below:

Title page, Item [54] and Column 1, line 1,
"ACCOMODATING" should read -- ACCOMMODATING --.

Column 1,
Line 29, "container" should read -- container, --; and
Line 61, "a" (first occurrence) should be deleted.

Column 8,
Line 44, "other" should read -- Other --.

Column 19,
Table 4, "hose" should read -- those --.

Column 22,
Line 30, "members" should read -- member --;
Line 45, "start" should read -- start, --; and
Line 46, "highest" should read -- highest, --.

Column 23,
Lines 15 and 29, "of" (first occurrence) should be deleted.

Signed and Sealed this

Twenty-ninth Day of April, 2003

JAMES E. ROGAN
*Director of the United States Patent and Trademark Office*